US009221168B2

(12) United States Patent
Boyd

(10) Patent No.: US 9,221,168 B2
(45) Date of Patent: Dec. 29, 2015

(54) WORKBENCH

(76) Inventor: Mark Lockyer Boyd, Suffolk (GB)

( * ) Notice: Subject to any disclaimer, the term of this patent is extended or adjusted under 35 U.S.C. 154(b) by 219 days.

(21) Appl. No.: 13/582,552

(22) PCT Filed: Mar. 3, 2011

(86) PCT No.: PCT/GB2011/000288

§ 371 (c)(1),
(2), (4) Date: Oct. 17, 2012

(87) PCT Pub. No.: WO2011/107740

PCT Pub. Date: Sep. 9, 2011

(65) Prior Publication Data

US 2013/0062823 A1 Mar. 14, 2013

(30) Foreign Application Priority Data

Mar. 3, 2010 (GB) ..... 1003494.0

(51) Int. Cl.

| | |
|---|---|
| ***B25B 1/00*** | (2006.01) |
| ***B25H 1/06*** | (2006.01) |
| ***B25H 1/04*** | (2006.01) |
| ***B25H 1/10*** | (2006.01) |
| ***B25H 1/16*** | (2006.01) |
| ***B25H 1/18*** | (2006.01) |

(52) U.S. Cl.
CPC .. *B25H 1/06* (2013.01); *B25H 1/04* (2013.01); *B25H 1/10* (2013.01); *B25H 1/16* (2013.01); *B25H 1/18* (2013.01)

(58) Field of Classification Search
USPC ..... 269/17
See application file for complete search history.

(56) References Cited

U.S. PATENT DOCUMENTS

| | | | | | |
|---|---|---|---|---|---|
| 145,174 | A | * | 12/1873 | Harden | 248/163.1 |
| 970,508 | A | * | 9/1910 | Kamrath | 182/155 |
| 1,481,503 | A | * | 1/1924 | Carswell et al. | 269/61 |
| 2,297,316 | A | * | 9/1942 | Padgett | 248/166 |
| 2,431,898 | A | * | 12/1947 | Witken | 182/155 |
| 3,643,935 | A | * | 2/1972 | Bell | 269/16 |
| 3,923,167 | A | * | 12/1975 | Blankenbeckler | 414/11 |
| 4,040,613 | A | * | 8/1977 | Kartasuk et al. | 269/247 |
| 4,180,252 | A | * | 12/1979 | Cushenbery | 269/17 |
| 4,239,197 | A | * | 12/1980 | Olstad | 269/68 |

(Continued)

FOREIGN PATENT DOCUMENTS

DE 19921455 A1 * 12/1999 ..... B65G 21/10

*Primary Examiner* — Lee D Wilson
*Assistant Examiner* — Alvin Grant
(74) *Attorney, Agent, or Firm* — William H. Bollman

(57) ABSTRACT

The workbench includes one or more trestle units (102) having pairs of legs (104) joined to each end of a cross-piece (106) by a hinge unit (108) which allows the legs to fold flat against each other and against the cross-piece of the trestle for storage. The hinge has a stop which allows the legs to be positioned away from each other and away from the cross-piece of the trestle to form a stable trestle unit. The workbench further includes a plurality of beams (500), wherein said beams are adapted to be connected to at least one trestle so as to form a supporting framework for a work piece. A folding brace (110) between pairs of legs further stabilizes the trestle. The beams and trestles have holes (126) in their ends, and the beams and the trestles have regularly spaced holes (128) in them. Pegs can be inserted into and through the holes, and they have locking parts on them, allowing them to lock onto the trestle or beam. Pegs can have two latches for attachment to different beams or trestles. Trestles and beams may be thus interconnected to form a supporting framework.

26 Claims, 15 Drawing Sheets

(56) References Cited

U.S. PATENT DOCUMENTS

| | | | | | |
|---|---|---|---|---|---|
| 4,260,038 | A * | 4/1981 | Plamondon | 182/164 |
| 4,278,243 | A * | 7/1981 | Alessio | 269/16 |
| 4,375,245 | A * | 3/1983 | Schill | 182/155 |
| 4,407,305 | A * | 10/1983 | Patterson | 460/140 |
| 4,570,915 | A * | 2/1986 | O'Hern | 269/295 |
| 4,756,386 | A * | 7/1988 | Blanchard | 182/153 |
| 4,782,917 | A * | 11/1988 | Schulz | 182/182.2 |
| 4,909,491 | A * | 3/1990 | Cheng | 269/16 |
| 5,101,932 | A * | 4/1992 | Trudgeon | 182/129 |
| 5,120,013 | A * | 6/1992 | Sweeney | 248/238 |
| 5,402,860 | A * | 4/1995 | Fry | 182/225 |
| 5,463,802 | A * | 11/1995 | Vachoux | 29/214 |
| 5,762,348 | A * | 6/1998 | Echternacht | 280/79.7 |
| 5,794,923 | A * | 8/1998 | Bartlett | 256/64 |
| 5,802,780 | A * | 9/1998 | Hammerschlag | 52/105 |
| 5,806,947 | A * | 9/1998 | Meisner et al. | 312/280 |
| 5,865,269 | A * | 2/1999 | Eskesen | 182/182.2 |
| 5,868,185 | A * | 2/1999 | Poling et al. | 144/286.5 |
| 5,904,225 | A * | 5/1999 | Patros | 182/181.1 |
| 5,924,684 | A * | 7/1999 | Cheng | 269/139 |
| 5,950,999 | A * | 9/1999 | Lin | 269/139 |
| 5,954,156 | A * | 9/1999 | Cooke | 182/153 |
| 6,070,696 | A * | 6/2000 | Chubb et al. | 182/227 |
| 6,095,319 | A * | 8/2000 | Noniewicz et al. | 198/632 |
| 6,283,250 | B1 * | 9/2001 | Asher | 182/153 |
| 6,286,824 | B1 * | 9/2001 | Sagol | 269/99 |
| 6,298,946 | B1 * | 10/2001 | Yemini et al. | 182/153 |
| 6,327,985 | B1 * | 12/2001 | Frenkler et al. | 108/147.19 |
| 6,328,330 | B1 * | 12/2001 | Haaser | 280/645 |
| 6,346,011 | B1 * | 2/2002 | Ikeda | 439/627 |
| 6,401,865 | B1 * | 6/2002 | Elwick | 182/182.1 |
| 6,659,440 | B2 * | 12/2003 | Levy | 269/45 |
| 6,827,181 | B2 * | 12/2004 | Austin et al. | 182/186.6 |
| 6,901,783 | B2 * | 6/2005 | Clark | 72/319 |
| 7,051,837 | B1 * | 5/2006 | Brahier | 182/21 |
| D536,800 | S * | 2/2007 | Kyle | D25/67 |
| 7,287,732 | B2 * | 10/2007 | Balistreri | 248/188.4 |
| 7,380,778 | B2 * | 6/2008 | Lawrence et al. | 269/139 |
| 7,418,907 | B2 * | 9/2008 | Haimoff | 108/91 |
| 7,484,700 | B2 * | 2/2009 | Selle | 248/188.4 |
| 7,731,205 | B2 * | 6/2010 | Wise | 280/47.131 |
| 7,815,215 | B1 * | 10/2010 | Lowe | 280/639 |
| 8,231,119 | B2 * | 7/2012 | Marshall et al. | 269/266 |
| 8,375,541 | B1 * | 2/2013 | Beachy et al. | 29/26 A |
| 8,708,103 | B2 * | 4/2014 | Bulley | 182/185.1 |
| 2005/0211856 | A1 * | 9/2005 | Niehoff | 248/127 |
| 2006/0091269 | A1 * | 5/2006 | Hanson | 248/188.4 |
| 2008/0236946 | A1 * | 10/2008 | Stephens | 182/153 |
| 2009/0107767 | A1 * | 4/2009 | Long | 182/186.1 |
| 2009/0283021 | A1 * | 11/2009 | Wong | 108/116 |
| 2010/0244351 | A1 * | 9/2010 | Totman | 269/296 |
| 2013/0092001 | A1 * | 4/2013 | Behr | 83/471.2 |

* cited by examiner

WORKBENCH

FIELD OF INVENTION

This invention relates to a workbench, more particularly, but not exclusively the invention relates to a foldable workbench having a plurality of interconnecting beams for supporting a piece of work.

BACKGROUND OF THE INVENTION

Workbenches are well known. An example of a very well known and highly commercially successful workbench has been sold for many years by 'Black & Decker' under the Registered Trade Mark Workmate®. The workbench has folds to a relatively smaller volume for stowage. However, when professional builders, carpenters and craftsmen needed to support larger items, particularly larger wooden items, such as bookcases, window frames, doors and gates, often two or more such workbenches had to be used in combination, sometimes together with other equipment.

These additional workbenches, and ancillary equipment, added to cost as well as posed problems when cutting or sawing large work pieces, because, for example if a large door or sheet of material, (such as plasterboard) had to be cut, often the person cutting the piece did not know the location of the workbenches supporting it. The consequence of this that often the work piece obscured the view of what was below it, and workbenches were inadvertently cut or damaged by the cutting tool blade or drill. Occasionally expensive tools, the work piece or workbenches were damaged. Not only was this sometimes inconvenient, it was also dangerous, possibly giving rise to injury.

Larger items of materials used in the building and construction trades, for example door, sheet material, length of pipe or length of timber, having dimensions in the range in excess of about 0.8 m-1.2 m have therefore been difficult to handle, support and work on using conventional portable workbenches.

PRIOR ART

Probably the most well known of the collapsible work benches mentioned above is that described in U.S. Pat. No. 4,157,174 (Hickman) in which a top supporting surface has moveable jaws that can provide a larger supporting surface as well as fold flat. Although extremely successful, this iconic workbench was intended for domestic and hobby use rather than workshop or professional craftspeople, who often carried two or more such workbenches in order to support larger work pieces. This entailed more cost and often gave rise to the problems that were mentioned above.

German Gebrauchsmuster DE 20 2006 007 062 U1 (Kleppel) discloses a universal workbench which is capable of supporting large work pieces. The bench however, is itself large and heavy and so is not readily transportable and because of its size and nature is expensive.

U.S. Pat. No. 2,983,389 (Trautmann) discloses a workbench with adjustable parts, which can be modified to accommodate a number of different size work pieces and perform different tasks. It is flexible and modular. However, it is also bulky, comprising large components which are heavy and it is not readily transportable. Furthermore the workbench comprises many differing components which entail it being expensive to manufacture and transport and it is complex to erect.

The present invention arose in an attempt to overcome problems associated with the aforementioned work benches.

An object of the present invention is to provide a modular work bench, and system, which is cheap to make, strong, and sufficiently adaptable so as to be capable of being able to be used in a wide variety of situations and able to support a wide range of work pieces.

Another object of the present invention is to provide a modular work bench which is collapsible for easy stowage; lightweight for easy transportation to/from building sites and places of work and is cheap, strong, and sufficiently adaptable so as to be capable of being able to be used in myriad applications.

SUMMARY OF THE INVENTION

According to a first aspect of the invention there is provided a workbench including: one or more trestles having legs; and a plurality of beams, wherein said beams are adapted to be connected to said at least one trestle so as to form a supporting framework for a work piece Ideally the trestles comprise frame portions having a cross piece and legs that are removable from the cross piece and foldable; in use the legs are operable to define an A-frame.

Preferably the frame portions have apertures formed therein, the apertures are shaped to receive inserts.

Ideally the legs have apertures formed therein, the apertures are shaped to receive inserts.

As the frame portions are fitted with apertures they are adapted to receive inserts which may be end portions of similar frames, elbow connections, T-connections, curved or straight connections so as facilitate the erection of a relatively complex frame structure.

The present invention therefore provides a configurable workbench system comprising one or more trestles and a plurality of interconnecting beams or crosspieces which in use are supported by the trestles, at varying angles, so as to form a supporting framework for a work piece. The framework is able to receive pegs in a plurality of different locations so as to support and hold a work piece in an optimal orientation and optimal height for it to be worked upon.

Workbenches may be combined together in a modular manner, using crosspieces as braces, so as to form one or more trestle units defining large 'table like' areas exceeding 2 m×2 m, ideally in excess of 2 m×3 m and preferably in excess of 3 m×3 m. As the workbenches are formed from tubular structures, and define effectively only a frame, they provide optimum strength to weight ratio, and despite the size of objects they can support, the workbenches can pack away and stow into relatively small volumes, sufficiently small to be carried in the boot (trunk) of an automobile, a van or a trailer.

Optionally the legs are joined to an end of a crosspiece by a hinge unit. In a preferred arrangement the hinge unit connects the legs to the crosspiece by way of a bolt and allows the legs, when collapsed, to fold flat against the cross-piece for storage. The hinge has a stop which allows the legs to be positioned away from each other and away from the crosspiece of the trestle to form a stable workbench.

In an alternative arrangement the legs may be detachable form the crosspiece and connectable thereto; and in this arrangement a lock member is provided for safety and so as to ensure the legs do not accidentally detach from the crosspiece.

Telescopic legs comprise at least one inner and one outer leg portion, the leg portions being movable with respect to one another and having a lock means for setting the length of a leg.

A clamp may be provided in order to lock leg portions with respect one to another. Alternatively a detent mechanism that is provided on one leg, such as sprung insert engages with apertures in another leg portion. Optionally both a variable clamp and a detent are provided.

Ideally assembled systems can include a plurality of inserts or peg portions projecting from a beam, cross piece or strut, arranged so that they define an array which in use contacts the surface of a work piece and holds it in a specific orientation.

Pegs may include U-shaped supports, S-shaped supports, H-shaped supports. Pegs may have cups, arched or domed shaped portions formed integrally therewith. Pegs can be L-shaped, have elbows, include corner pieces or vices. They may support gripping means and/or rotatable portions and/or G-clamps.

In a particularly preferred embodiment the array comprises a plurality of pegs of substantially the same length which are in contact with a planar portion of a work piece. Such a work piece may be a sheet of plasterboard or glass, in excess of 3 meters in length and greater than 1 meter in width.

Ideally a clamp is provided for retaining the work piece in close contact with the array of legs. The clamp is provided for retaining the work piece in close contact with the array of pegs.

Advantageously the clamp is supported on a beam, cross piece or strut, which in use is tiltable The clamp may be defined by a finger or right angled L-shaped piece which is placed around an edge, and extending only a part way across of the work piece, or it may extend across the entire work piece and A folding brace between pairs of legs further stabilises the workbench. The crosspieces and legs have apertures in their ends, and the beams and the trestles have regularly spaced apertures in them.

It is appreciated that a basic work bench can therefore be dismantled and is foldable into a bag or sack of approximate maximum dimensions that correspond to the length of a cross piece and the legs. This enables the work bench to be broken down and packed in a bag whose dimensions are approximately 30 cm width×30 cm height×1 m length.

As the sections are formed from hollow square steel tubal struts, the total weight of a single folded workbench may be of the order of 10-20 kg. A typical leg length is between 40 and 60 cm and a typical length of a cross piece is typically between 1 m and 1.5 m. Typically the cross section of a strut is between 2 and 5 cm and the thickness of sheet metal is between 2 mm and 5 mm.

Clearly a lightweight domestic/hobby version of the workbench is envisaged formed from small and thinner units and a larger commercial range is envisaged. In the case of more than one range, it is preferred that the individual crosspieces and legs will not be interchangeable from one range to another (for safety purposes) as this might otherwise be hazardous. Practically this may be achieved for example by suitable non-compatible end fittings, colour coding or a variety of other well known techniques.

Previously for example some workbenches were only able to hold a work piece on a horizontal work surface. Optionally by way of a clamp or vice, the work piece was held tightly flat against the work surface. The present invention ideally includes a movable frame portion that is adapted to tilt so as to define a supporting surface for a work piece that is not horizontal but which can be oriented to a range of angles from horizontal to vertical.

Inserts are ideally shaped to be received in the apertures defined in the legs and crosspieces and the inserts or pegs may take a variety of shapes and forms. Likewise different fittings may be formed therewith. The pegs may be of different lengths, typically 5 cm, 10 cm, 20 cm and 40 cm. Ideally these lengths are colour coded and so can be readily distinguished one from another.

One example of an insert is a peg that has a rubber end. This is to provide a gripping surface to a work piece. In another example an end may have a leather or synthetic rubber cap, so as to prevent scratching and transmission of shocks which might otherwise shatter a sheet of glass.

In an alternative embodiment pegs may be able to act in a similar manner to a splint and grip items placed between separate portions by way of a tightening means which is preferably threaded.

Another example of a peg has a spirit level formed integrally therein. This is to enable the user to level the workbench. In an alternative arrangement a spirit level can be included in a crosspiece so that upon erection a user is able to ensure the level of the workbench is true.

Another example of a peg has a rotary foot fitted to a threaded shaft and this enable raising and lowering of the feet so that the workbench can be positioned on uneven surfaces thereby ensuring that the work bench is stable.

A further example of an insert is a one that supports a flat bed, typically of around 0.05 m square, optionally 0.1 m square and alternatively 0.2 m square.

Another example of an insert supports an extension arm, which is optionally on an rotary joint, such as a ball-and-socket joint, and so permits swivelling of the peg in a two planes.

It is understood that, because the system is modular, pegs may be inserted one inside another so as to enable hybrid systems to be produced for specific and specialised tasks. For example, when cutting a large work piece, often the operator of the circular saw cannot see behind the work piece. In such situations, pegs may be fitted with alarms adapted to provide an audible alert of a peg being struck by a saw or cutting edge.

Alternatively sacrificial pegs may be provided which are in the form of softwood inserts dimensioned and arranged to be insertable into the apertures at the end of suitable endless pegs, and which may be cut off and then discarded, in the event that a user accidentally (or deliberately) cuts through them, as they are inexpensive and soft.

Alternative inserts or pegs may be case hardened so that they are rendered sufficiently hard so they are not prone to cutting.

Other pegs include a rollable, case hardened jacket, that is provided so as to prevent damage to saws and cutters.

In a yet further embodiment pegs may be formed with a stiff bristle end or foam rubber tip so as to be compliant for placing against surfaces that might scratch or shatter if shocked, such as glass, ceramic tiles or glass panels for windows or doors. In such cases a soft material cover, rather like a sock, may be placed over the a stiff bristle end or foam rubber tip so as to provide a low friction surface over which to slide the glass thereby avoiding scratching.

Pegs can be inserted into (and optionally through) the holes or apertures formed in the crosspieces, frames or legs, and optionally have locking means on them, allowing them to lock onto the frame (work piece, trestle or beam). The locking means may be of the twist type, with a ratchet mechanism that expands an end portion of the peg when fitted in an aperture. Alternatively a detent can be provided on a peg which engages positively with an aperture when a peg is driven 'home'.

Pegs can have two or more latches for attachment to different beams or trestles and for interconnecting one item to another.

Pegs or inserts may be straight, curved or L-shaped. Trestles and beams may be thus interconnected to form a supporting framework.

Other accessories are provided for specific tasks such as providing an angled support strut. These angled supports are typically rotary and are able to be locked in a position. By placing an angled support strut at either end of a workbench a user is able to swivel two side struts and locate them at an angle to the vertical.

Interconnecting crosspieces can be used to join the side struts and thereby define a frame portion. Pegs or inserts can be fitted to the frame portion and a lower L-piece can be added to act as a shelf, thereby defining a support surface for a work piece which presents it an angle and enables both faces to be viewed whilst being working on.

Accessories can be attached to the workbench or formed integrally with component parts. One such accessory is a spirit level which was mentioned earlier. Another is a plumb line which can prove the workbench level on the ground.

Other accessories include low voltage or batter powered appliances such as lamps, fitted integrally with pegs or work pieces, for example for use in dark conditions or when lighting fails.

Another example of an accessory is an electrician's cable connector, a residual current detector (RCD) for isolating power supplies in an emergency. An advantage of fitting these accessories is that they are always available on-site when a workbench is being used and so from a health and safety point-of-view are always available for use with power tools and electric saws an cutters.

Other examples of accessories are: rubber feet for working in slippery conditions, covers for apertures, for use when working in dusty environments and removable end caps for cleaning crosspieces, legs and inserts when they become filled with sawdust or debris.

Other accessories include wheels, which may be detachable or permanently fixed so as to enable large assembled workbench structures to be moved; or wheels permit folded structures to be rolled into suitable storage spaces, cupboards or recess.

Another accessory may include a jack for items fitted with Bluetooth (Trade Mark) devices sensors, alarms or sensors for detecting a risk of tipping or toppling, such as solid state gyroscopes.

Preferred embodiments of the invention will now be described, by way of example, and with reference to the Figures in which:

BRIEF DESCRIPTION OF DRAWINGS

For a more complete explanation of the present invention and the technical advantages thereof, reference is now made to the following description and the accompanying drawing in which.

DETAILED DESCRIPTION OF PREFERRED EMBODIMENTS OF THE INVENTION

Figure 1:
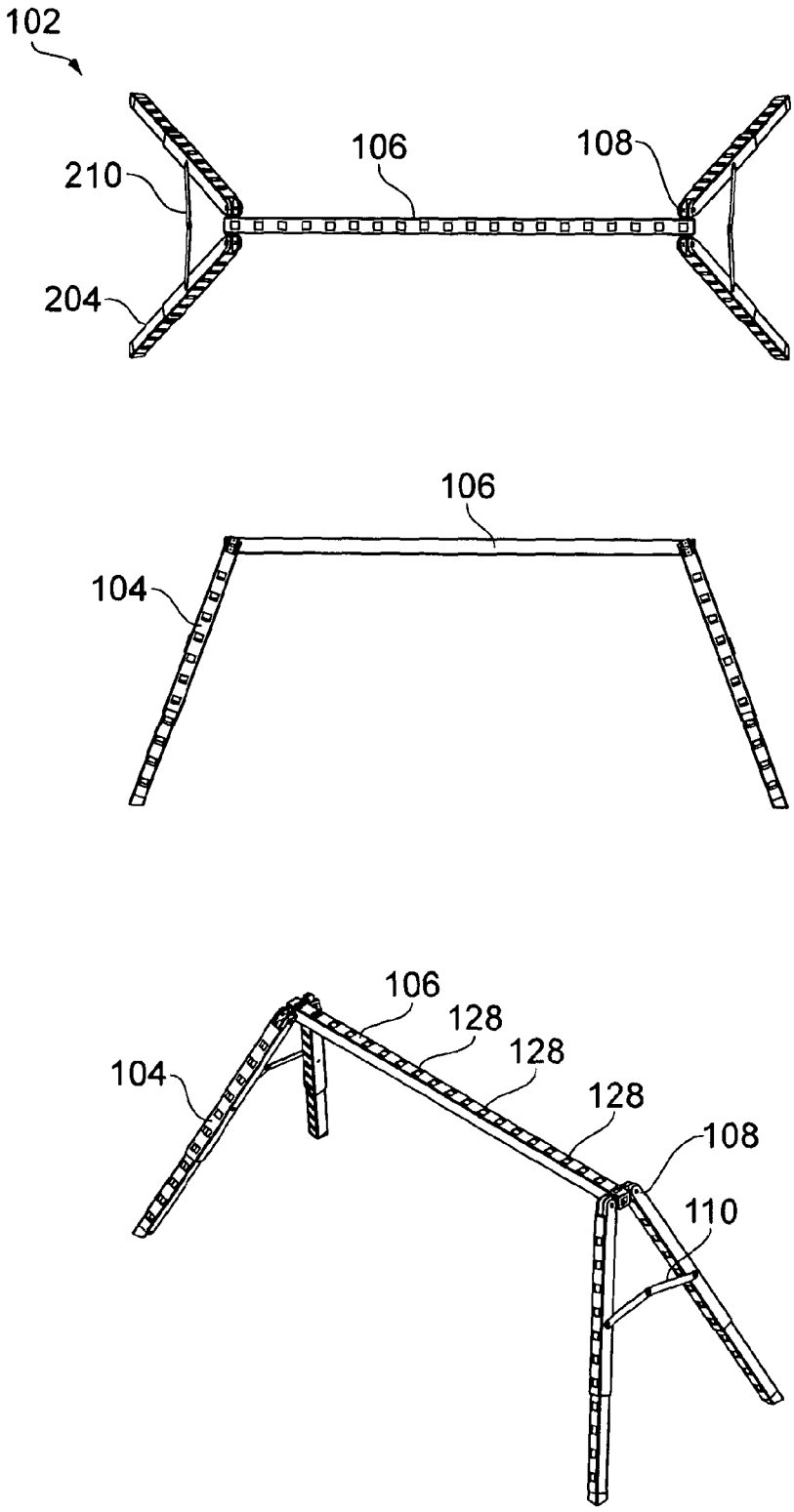
FIG. 1 shows plan, elevation, and isometric views of a trestle unit of the present invention.

Embodiments of the present invention and their technical advantages may be better understood by referring to FIGS. 1-14.

This is a configurable a workbench that includes one or more trestles (102) having legs (104); and a plurality of beams (500). The beams (500) are adapted to be connected to the trestle (102) so as to form a supporting framework for a work piece. Trestles comprise frame portions that have cross pieces 106 and legs (104) that are optionally removable from the cross piece (106) and foldable as explained in greater detail below. In use the legs (104) are operable to define an A-frame.

The work piece, which may be a sheet of plywood, glass or wood is a generally larger item of material as used in the building and construction trades, for example door, sheet material, length of pipe or length of timber.

Typical dimensions of such objects are in the range of about 0.8 m-1.2 m wide to 1.5 m-3.0 m in length.

Referring now to FIG. 1, which shows several views of a trestle unit (102) of the present invention, pairs of legs (104) are joined to each end of a crosspiece (106) by a hinge unit (108) which allows legs to fold flat against each other and against the cross-piece of the trestle for storage. The hinge has a stop (not shown) which allows the legs to be positioned away from each other and away from the crosspiece of the trestle to form a stable trestle unit.

Figure 2:
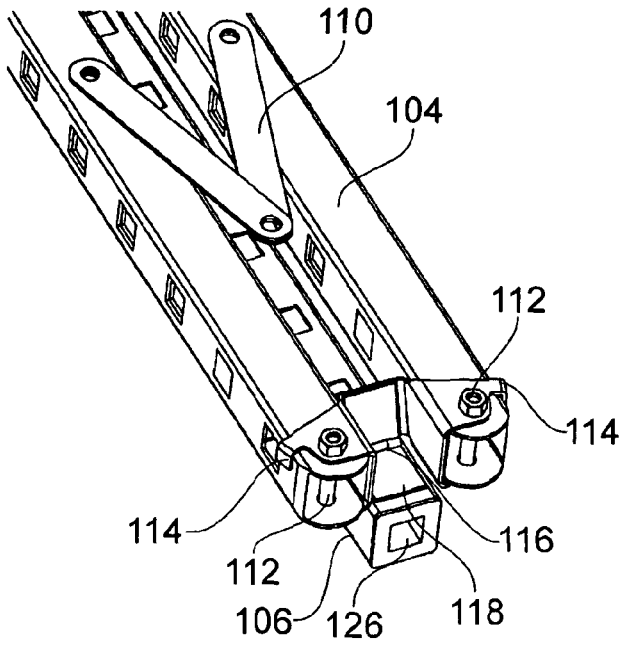
FIG. 2 shows a partial view of a trestle in a folded position.

A folding brace (110) between pairs of legs further stabilises the trestle. Referring now to FIG. 2, which shows the trestle in a folded position, the hinge has two folding parts (112) which allow the legs to be rotated away from each other until they reach a stop (114) and are held in position by the brace, and a third folding part (116) which allows the legs to be swung away from the crosspiece until they reach a stop (118).

Figure 3:
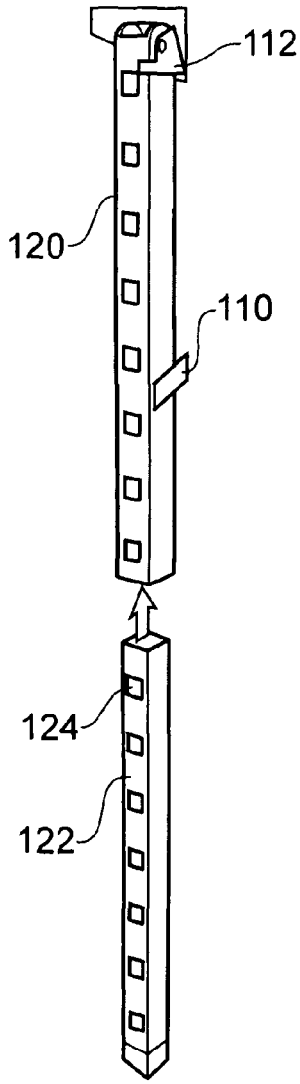
FIG. 3 shows one embodiment for adjustable trestle legs.

The length of the legs can be adjustable, and the height of the trestle may be set in the range 0.5-1 m. Referring now to FIG. 3, which shows one embodiment for adjustable legs, the legs have an outer member (120) and an inner member (122), and the inner member slides out from said outer member. The position of the inner member in relation to the outer member is set by a latch (124) on one member engaging a slot in the other.

The beams and trestles have holes in their ends (126), and the beams and the trestles have regularly spaced holes (128) in them. Pegs can be inserted into and through the holes, and they have locking parts on them, allowing them to lock onto the trestle or beam. Pegs can have two latches for attachment to different beams or trestles. Trestles and beams may be thus interconnected to form a supporting framework.

Figure 4:
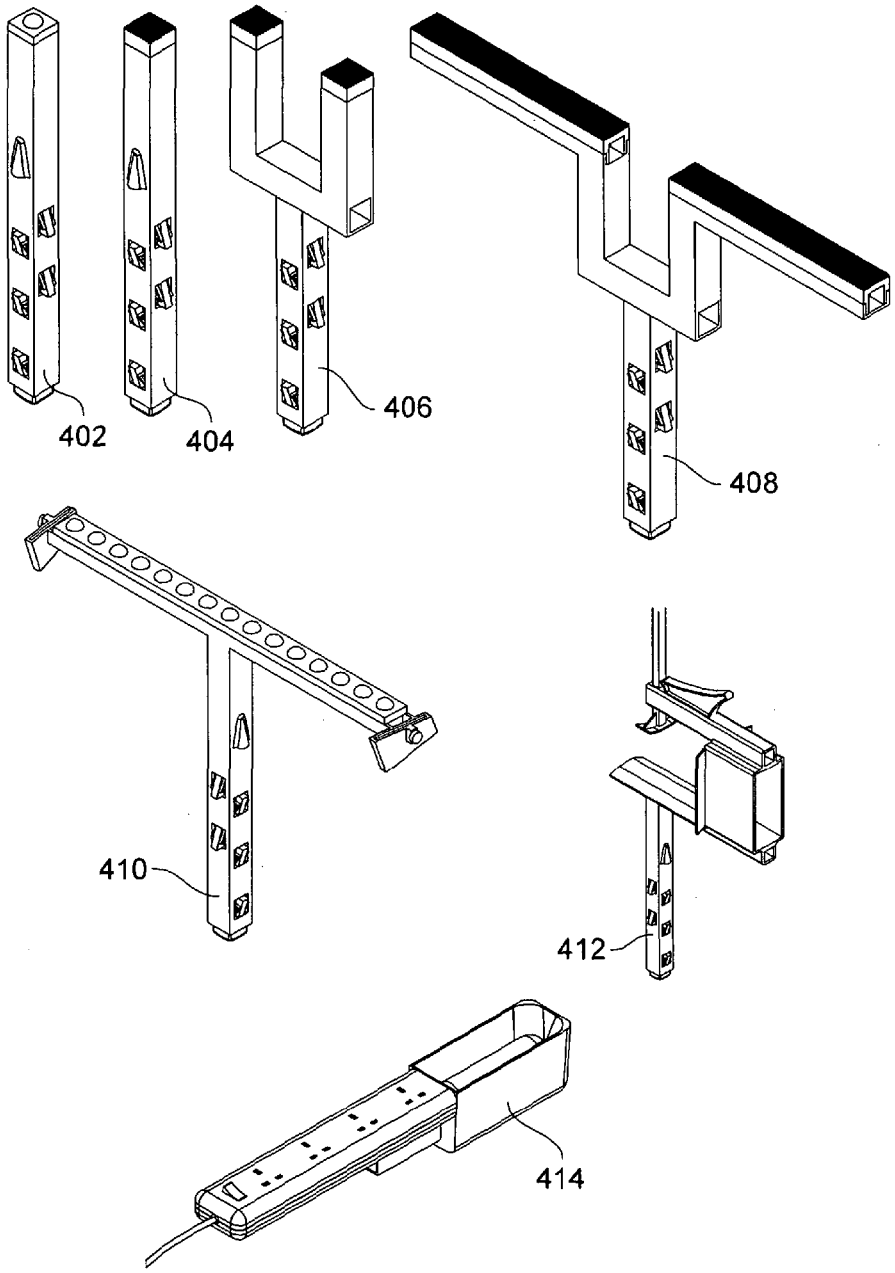
FIG. 4 shows embodiments of pegs having functional end pieces.

In addition to their function of joining trestles and beams to form a supporting network, the peg can have a functional end piece. Referring now to FIG. 4, which shows embodiments of pegs having functional end pieces, the end pieces include a rubber-top peg (402), a roller peg (404), a u-shaped peg (406), a ripping peg (408), a t-bar (410), a G-clamp (412) and a peg having a lamp and an electrical extension block (414).

Figure 5:
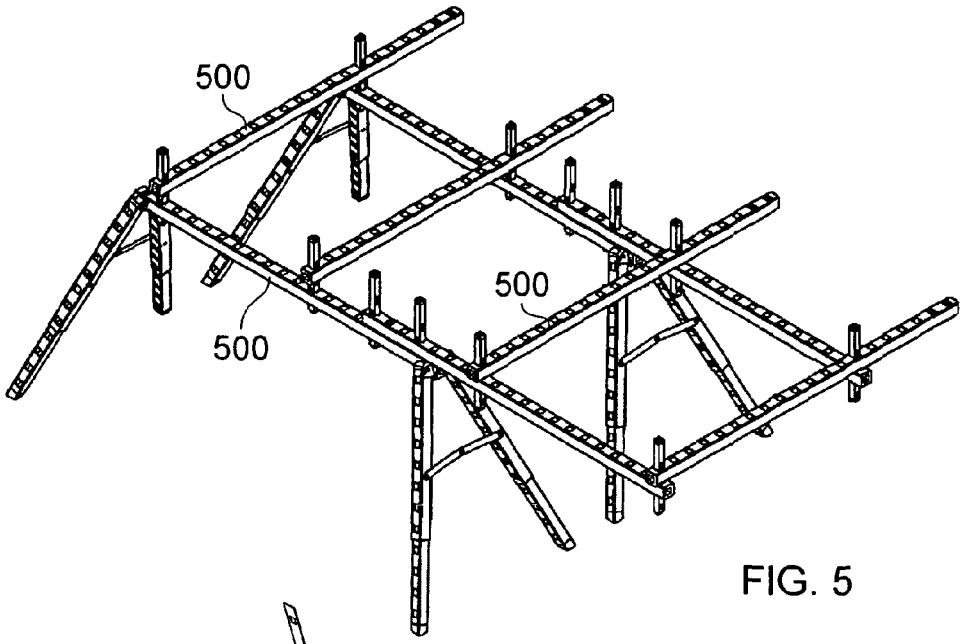
FIG. 5 shows a workbench of the present invention comprising a framework of beams and trestles.

Rubber end piece pegs can for example be used in an array arranged on the beams so that a large flat piece of material for working on can be supported by the trestle system. Such a framework of beams and trestles is shown in FIG. 5.

Figure 6:
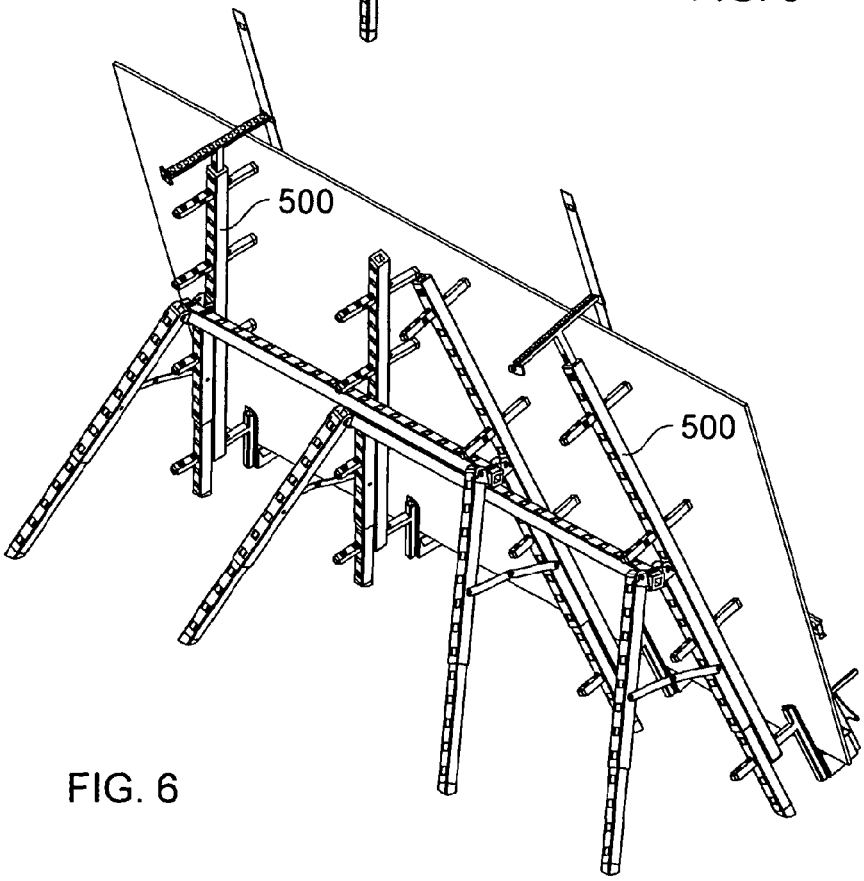
FIG. 6 shows a workbench of the present invention comprising a slanted array of beams for supporting a work piece.

The pegs may also be used to secure beams to the legs of the trestle, which gives a slanted array of beams against which a piece of work may be supported, as shown in FIG. 6.

Figure 7:
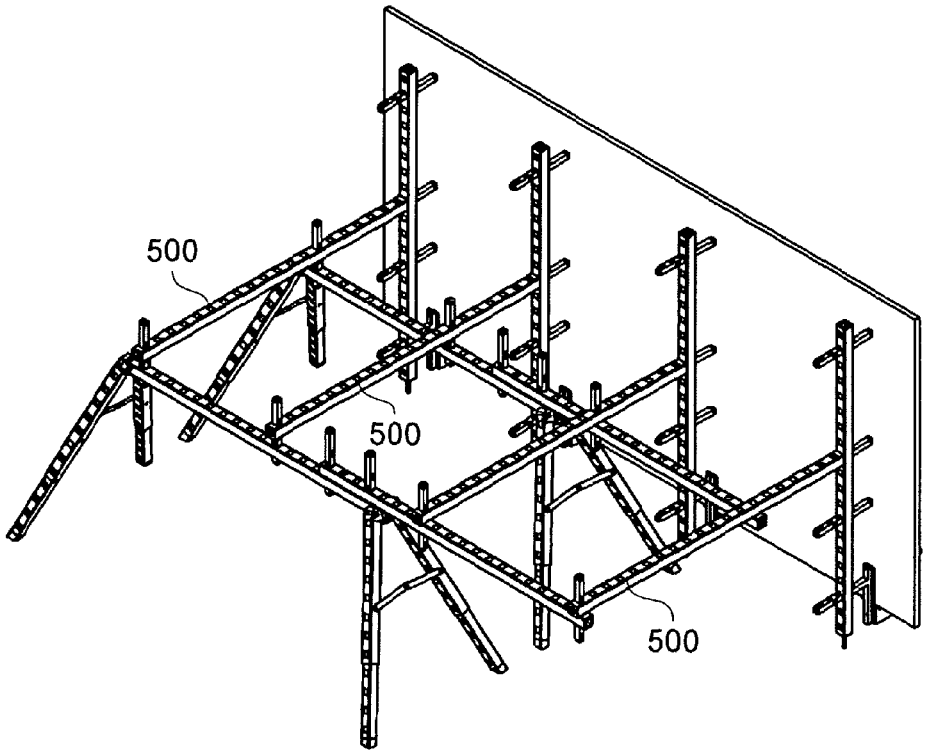
FIG. 7 shows a workbench of the present invention comprising vertically disposed beams for supporting a work piece.

The pegs may also be inserted into the ends of the beams, allowing vertically disposed beams to be attached to them, as shown in FIG. 7.

Figure 8:
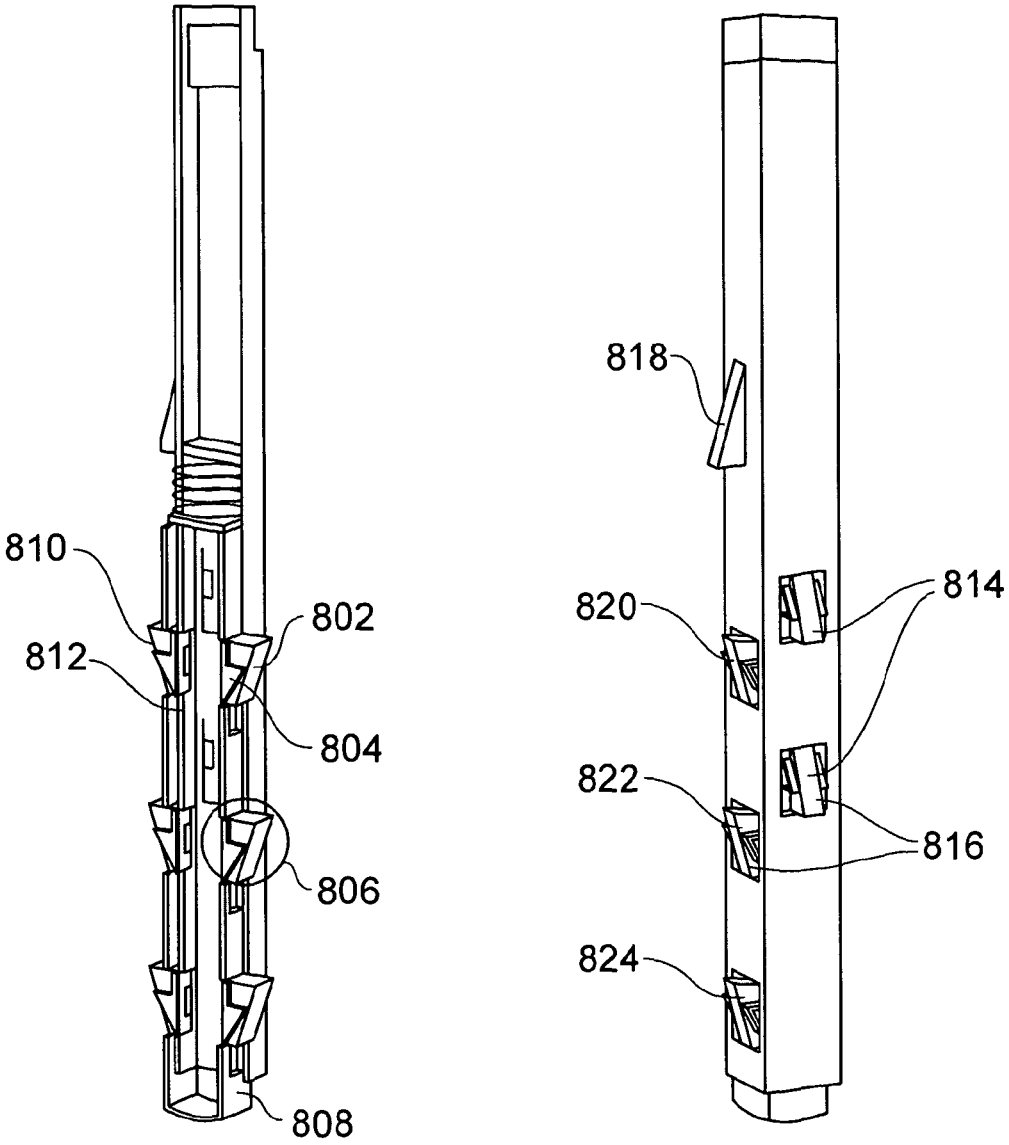
FIG. 8 shows views of a peg.

Referring now to FIG. 8, which shows two views of a peg of the present invention, a stop (818) on the side of the peg limits how far the peg can move through a hole in the trellis or a beam. If it is required that the beam is in a higher position then, the peg can be lifted out of the hole until first spring-loaded latch (814) engages. For a yet higher position, the peg can be lifted out of the hole until a second spring-loaded latch (816) engages.

The peg can also include a more complex dual cam latch system having a first cam (802) and a second cam (804). The first cam engages with the edge of a hole into which it is inserted and the cam is depressed. This means that when the peg is pushed into a hole, the latches (810), which have a hinge (812), move in and lock with the interior of the hole.

The second cam (804) engages with an inner sheath (808), and as the sheath is pushed upwards against a spring, the first cam is depressed and the latch disengages. Thus one beam can latch between position (818) and (820); two stacked beams can latch between (818) and (822), and three stacked beams can latch between (818) and (824).

Figure 9:
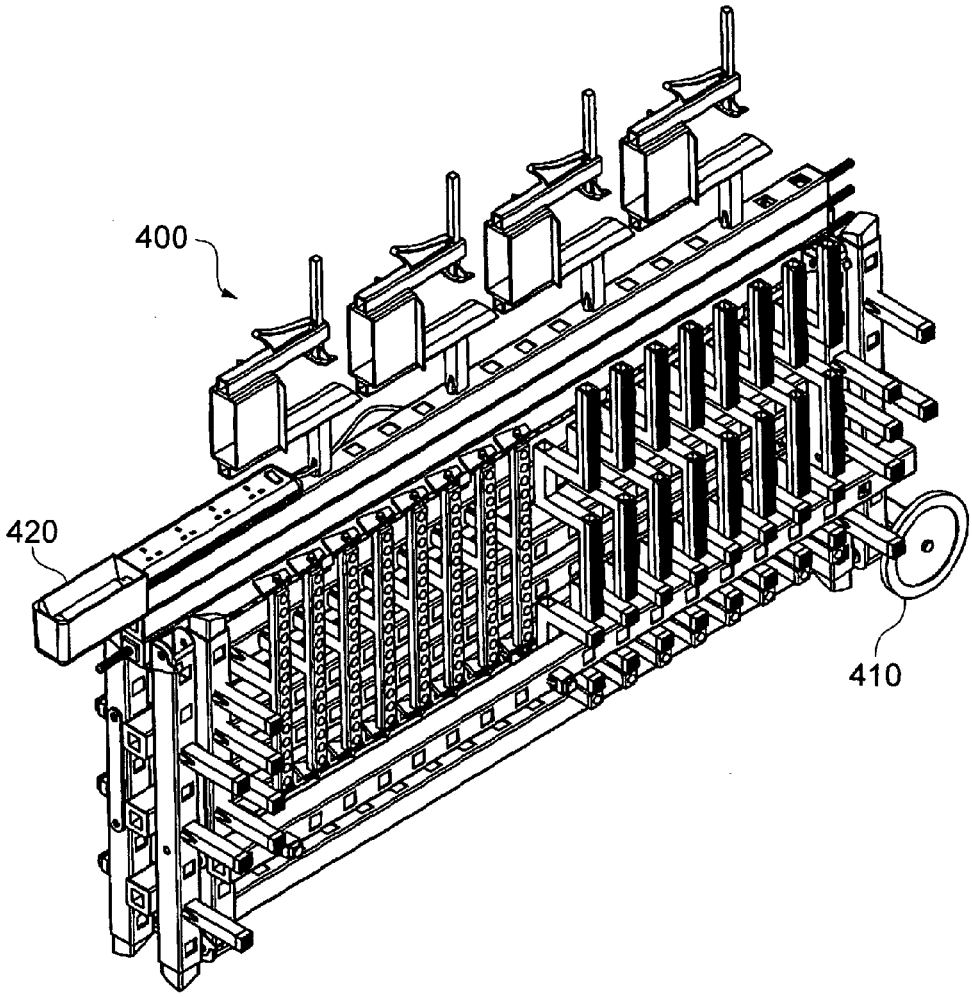
FIG. 9 shows a trolley for storing and transporting the workbench.

The workbench of the present invention can be dismantled and stored on a trolley 400 of the kind shown in FIG. 9. Advantageously the trolley includes a caster or wheel 410 which rolls as it is pulled along by portion that serves as a handle 420.

Figure 10A:
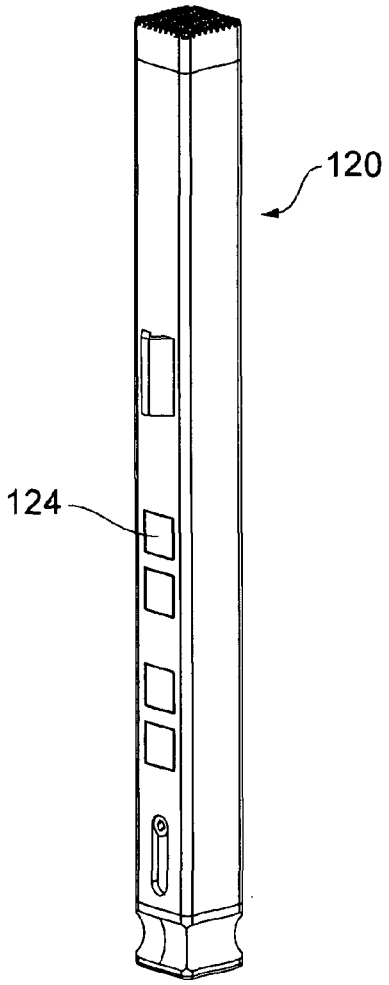
FIGS. 10 to 12 show overall views of examples of pegs.
Figure 10B:
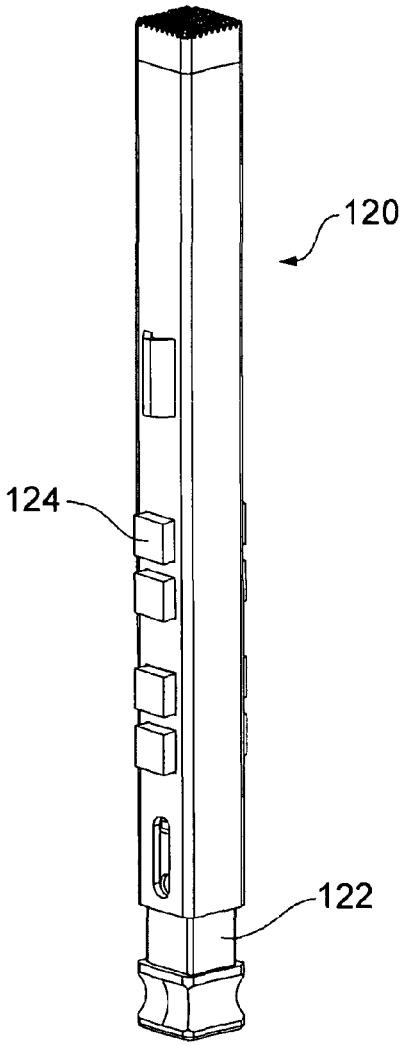
Figure 11:
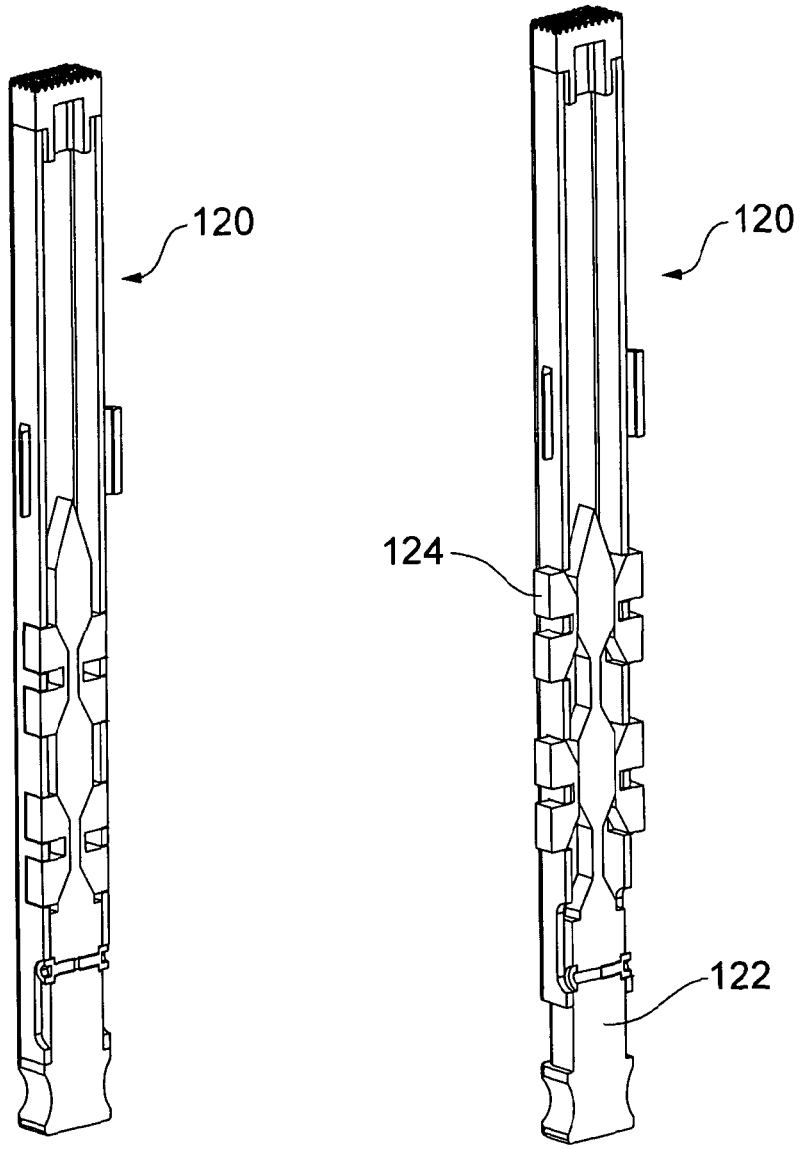
Figure 12:
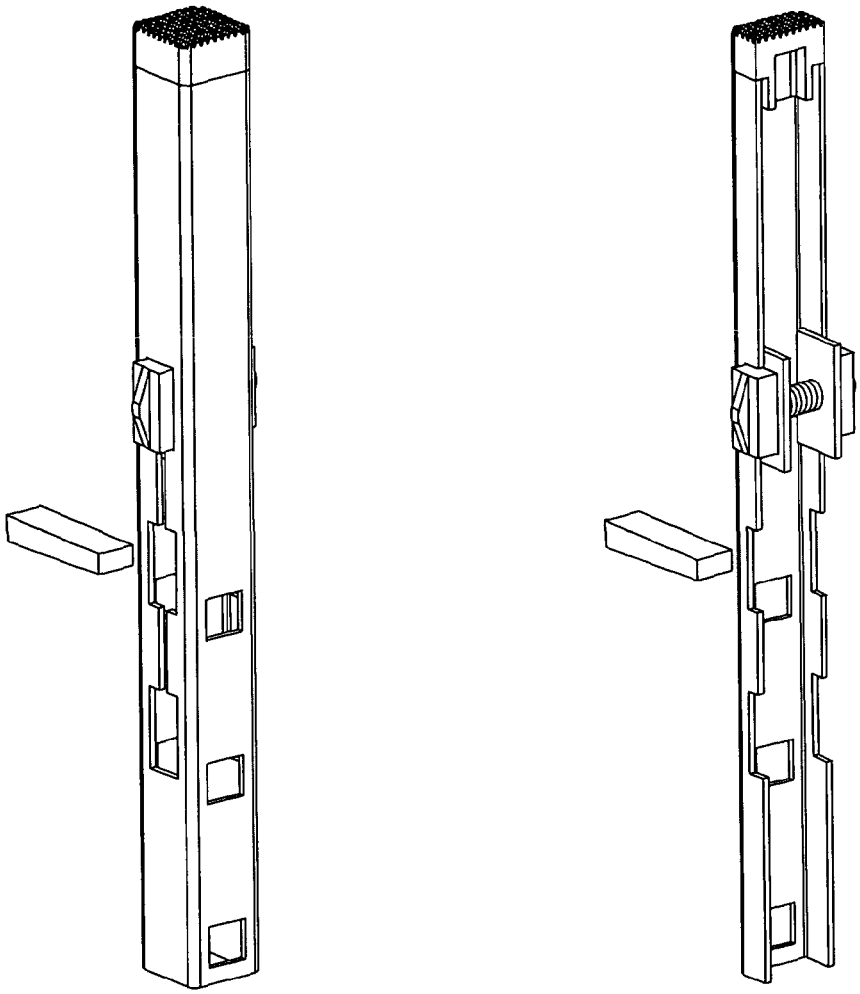

Referring briefly to FIGS. 10 to 12 inclusive there is shown views of alternative embodiments of the peg, in which like parts bear the same reference numerals as in the other Figures.

FIGS. 10*a* and 10*b* show an example of a peg that is fitted with an insert for varying the effective length of the peg and has a pinch mechanism arranged to hold the insert at a specific location in one of its apertures.

FIGS. 11*a* and 11*b* and 12*a* and 12*b* show examples of a telescopic foot for use with legs.

The inner and outer members shown in FIGS. 10 and 11 slide similarly as described above with reference to FIG. 3.

Figure 13:
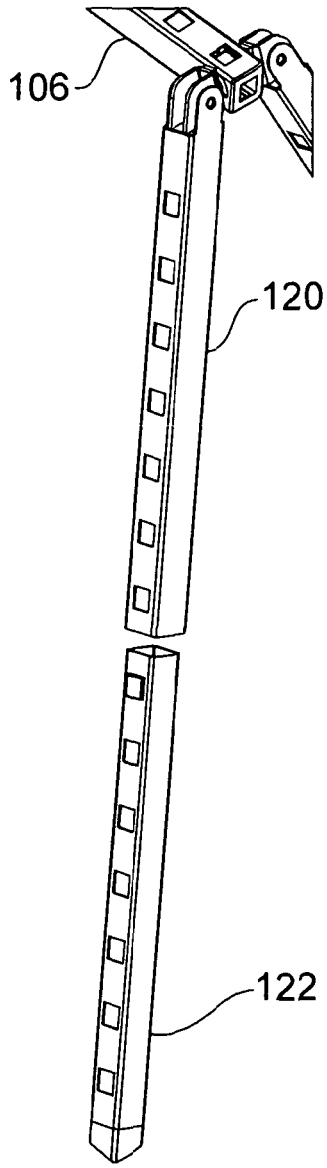
FIG. 13 is a partial view of another example of a leg.

FIG. 13 is a partial view of another example of a leg and illustrates the interconnection of the A-frame with the crosspiece.

Figure 14:
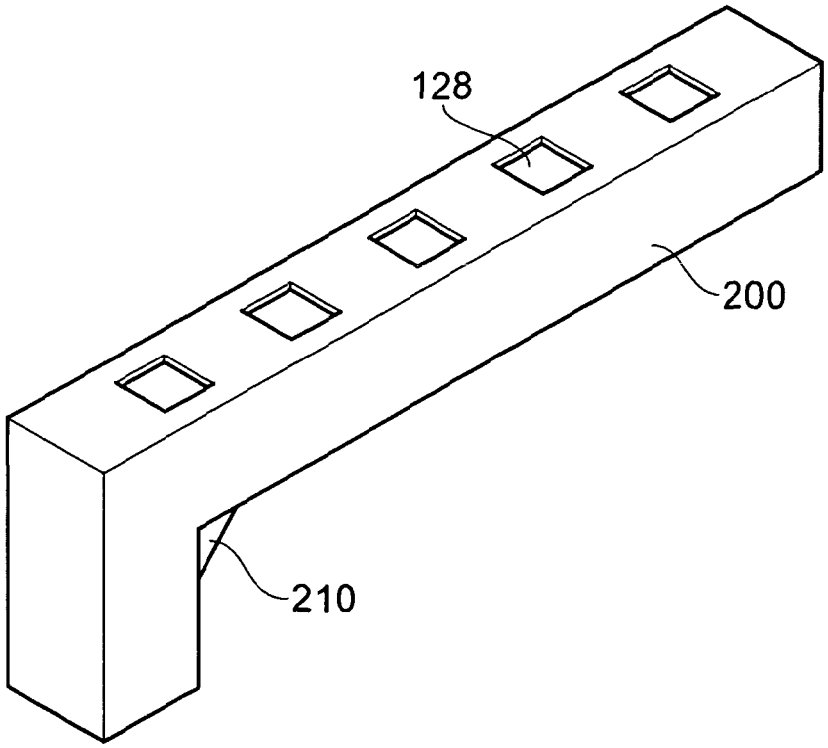
FIG. 14 is a diagrammatical view of an L-shaped peg and shows a strengthening rib or flange support.

FIG. 14 is a diagrammatical view of an L-shaped peg (200) and shows a strengthening rib or flange 210 support for use with heavier items.

Figure 15:
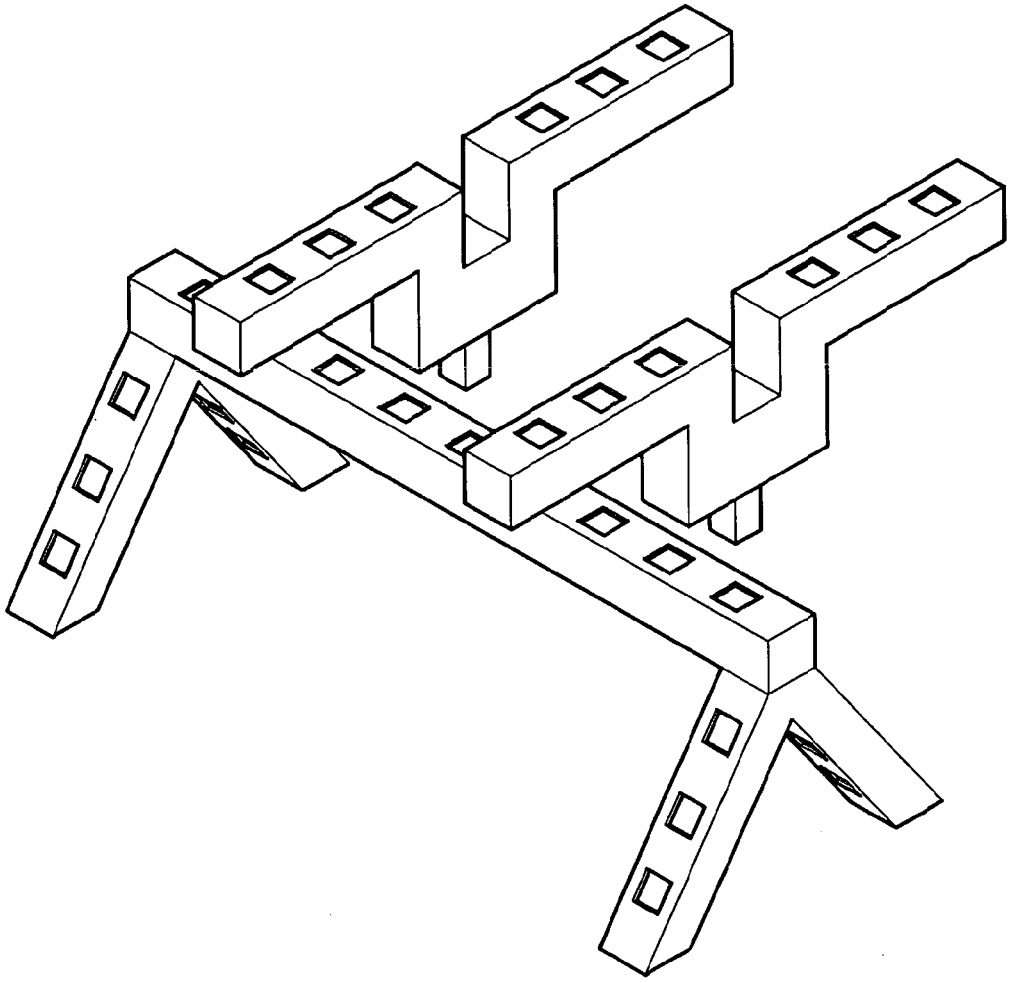
FIG. 15 is an isometric, diagrammatical view of a trestle unit with Y pegs inserted into a crosspiece.

An isometric view of the trestle unit, Y pegs 300 are shown inserted into the crosspiece 106 in FIG. 15. The Y pegs allow a piece of work to be supported on wings 310, thereby enabling an effective area of a workbench to be expanded substantially.

Advantageously one type of work piece that can be supported with the aid of a Y peg is a flat board. Furthermore a single trestle with Y pegs 300 in the crosspiece 106 can support a board horizontally. Y pegs obviate the need to have a second trestle to support a board horizontally.

Figure 16A:
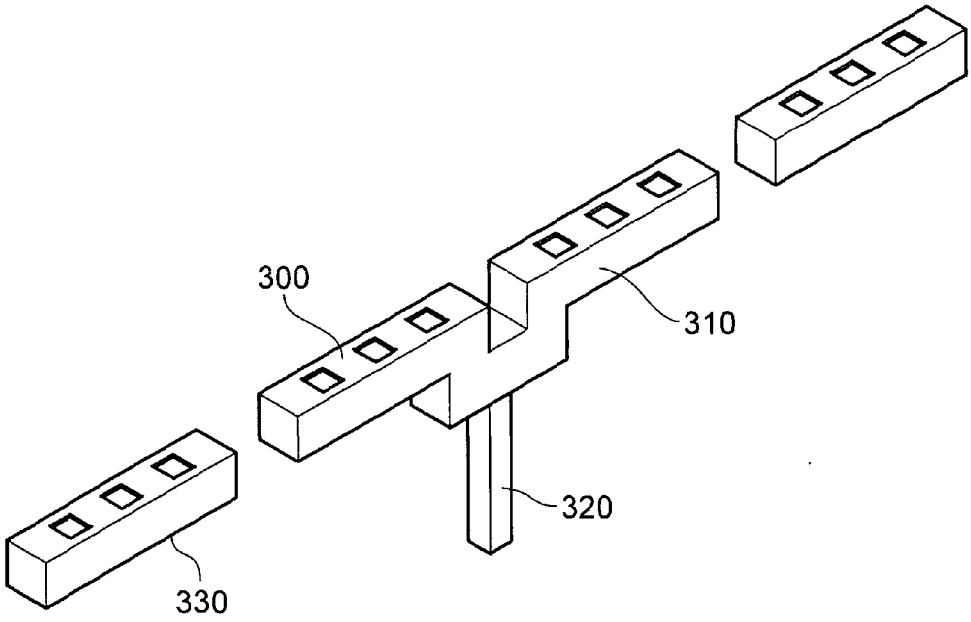
FIG. 16*a* shows an isometric view of a Y peg.

As FIG. 16 shows, each Y peg 300 has a stem 320. The stem 320 inserts into the hole 128 of the crosspiece 106 with a snug fit that prevents the Y peg 300 from wobbling. Extension pegs 330 are insertable into wings 310 and thereby extend the effective working surface of the workbench.

Suitable colourings or other markings, may be used to indicate the safe weight limit of components and accessories It is to be appreciated that these Figures are for illustration purposes only and other configurations are possible.

The invention has been described by way of several embodiments, with modifications and alternatives, but having read and understood this description further embodiments and modifications will be apparent to those skilled in the art.

For example although reference has been made to use of steel or aluminium, it is understood that other materials may be sued including alloys, composites and synthetic materials. All such embodiments and modifications are intended to fall within the scope of the present invention as defined in the accompanying claims.

Furthermore the invention may have magnetic portions connected to the struts or formed integrally therewith. In an alternative embodiment the invention may be provided in a form suitable as plaything for children, such as a toy.

Figure 16B:
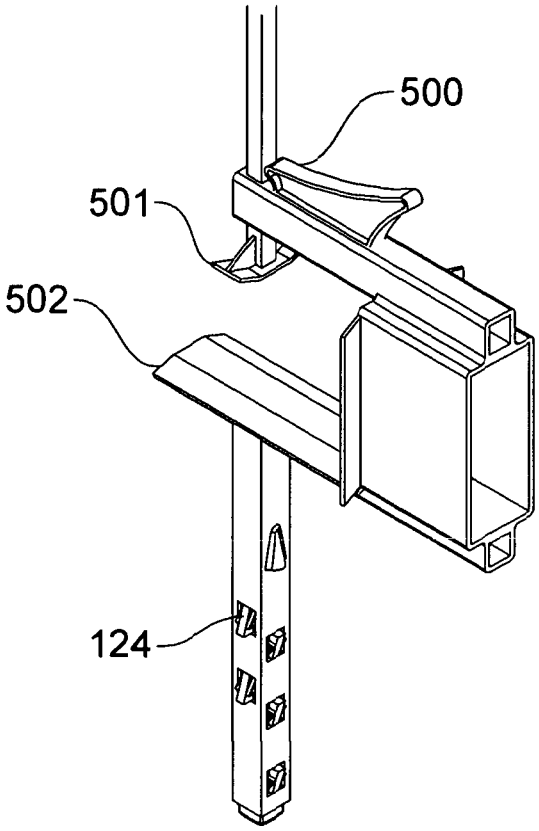
FIG. 16*b* is an example of a clamp.
Figure 16C:
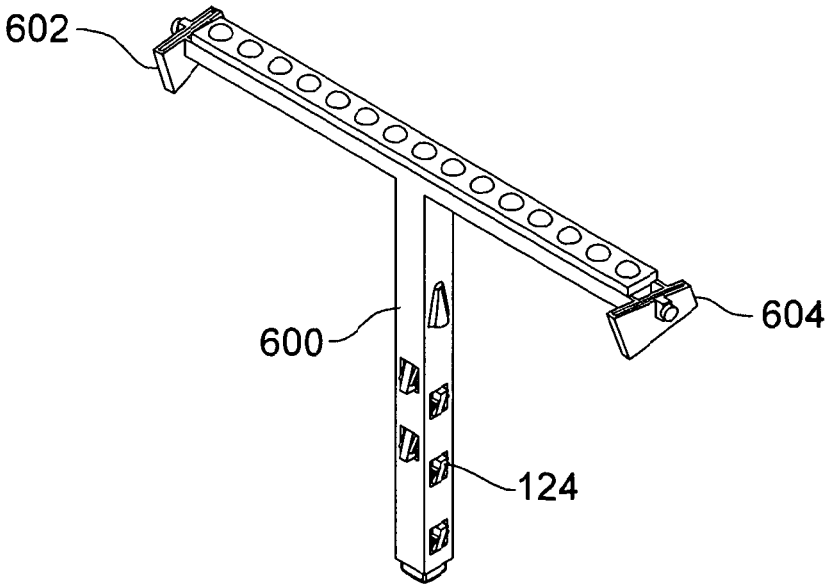
FIG. 16*c* is a T-bar with a rotary fitting.

The invention may also be provided in a kit form, supplied as a basic trestle and legs and a selection of pegs, to which additional pieces may be added as required:

FIGS. 16*b* and 16*c* show in greater detail, two of the examples of inserts shown in FIG. 4. The inserts are shown generally in situ in FIG. 9. The inserts in FIGS. 16*a* and 16*b* have engagement means 124 located on the peg portion, which in use is inserted into a work piece or frame or a strut. The G-clamp shown in FIG. 16*b* has a ratchet 500 and a foot 501 that grips a work piece and urges it tight against foot 502.

Swivel connections 602 and 604 of rotary fitting 600, shown in FIG. 16*c*, permit work pieces or a frame portion to rotate with respect to the vertical.

The invention claimed is:

1. A workbench, comprising:

a plurality of legs that are connected with a crosspiece to define at least one trestle, said at least one trestle supporting a plurality of beams;

wherein at least said plurality of beams and said crosspiece have apertures that are adapted to receive inserts, said inserts having end portions for supporting a planar workpiece;

wherein said plurality of legs are displaceable with respect to said crosspiece, and said plurality of beams are removable from said crosspiece so that said plurality of legs, said crosspiece, said plurality of beams, and said inserts are stowable;

wherein in use, said inserts are inserted into said apertures in said plurality of beams or said crosspiece, said inserts being lockable with respect to said apertures; and wherein said end portions of said inserts define a support surface lying in a common plane for supporting said planar workpiece at some distance from said plurality of beams and from said crosspiece, thereby enabling said planar workpiece to be cut without damage to said plurality of beams or to said crosspiece.

2. The workbench according to claim 1, further comprising:

a hinge unit to join said plurality of legs to an end of said crosspiece.

3. The workbench according to claim 1, wherein:

interconnecting ones of said plurality of beams are capable of being held at varying angles with respect to said crosspiece.

4. The workbench according to claim 1, wherein:

said inserts are in a form of pegs so as to hold said planar workpiece in an optimal orientation and optimal height to be worked upon.

5. The workbench according to claim 4, wherein said pegs are from a group comprising:

elbow connections;

L-connections;

T-connections;

Y-shaped connections;

curved connections; and straight connections.

6. The workbench according to claim 1, wherein:

said plurality of beams, said crosspiece, and said plurality of legs are formed from tubular components.

7. The workbench according to claim 2, wherein:

said hinge unit connects said plurality of legs to said crosspiece by way of a bolt, and allows said plurality of legs, when collapsed, to fold flat against said crosspiece for storage.

8. The workbench according to claim 7, wherein:

said hinge unit includes a stop which allows said plurality of legs to be positioned apart from each other and away from said crosspiece of said at least one trestle to form a stable workbench.

9. The workbench according to claim 1, wherein:

said plurality of legs are telescopic, and comprise at least one inner leg portion and at least one outer leg portion, said at least one inner leg portion and said at least one outer leg portion are movable with respect one to another;

said workbench further comprising a lock means for locking said at least one inner leg portion and said at least one outer leg portion with respect one to another.

10. The workbench according to claim 9, further comprising:

a detent mechanism provided on said at least one inner leg portion, said detent mechanism being adapted to engage with an aperture in another leg portion.

11. The workbench according to claim 10, wherein said detent mechanism comprises:

a sprung insert.

12. The workbench according to claim 9, further comprising:

a detent mechanism provided on said inserts, said detent mechanism being adapted to engage with an aperture in a leg portion.

13. The workbench according to claim 12, wherein said detent mechanism comprises:

a sprung insert.

14. The workbench according to claim 1, wherein:

said inserts have cups formed thereon.

15. The workbench according to claim 1, wherein:

said inserts have arched portions formed thereon.

16. The workbench according to claim 1, wherein:

said inserts have a domed shaped portion formed thereon.

17. The workbench according to claim 1, wherein:

said inserts have rubber ends formed thereon.

18. The workbench according to claim 1, wherein:

said inserts have synthetic bristles formed thereon.

19. The workbench according to claim 1, wherein:

said inserts have a hardened outer casing formed thereon.

20. The workbench according to claim 1, wherein:

said inserts have a spirit level formed thereon.

21. The workbench according to claim 1, further comprising:

a clamp provided on a strut for retaining said planar workpiece in close contact with a supporting array of inserts.

22. The workbench according to claim 21, wherein said clamp comprises:

a finger or right angled L-shaped piece which is placed around an edge;

wherein, in use, said finger or right angled L-shaped piece extends only a part way across said planar workpiece.

23. The workbench according to claim 21, wherein said clamp comprises:

a finger or right angled L-shaped piece which is placed around an edge;

wherein, in use, said finger or right angled L-shaped piece extends across the entire planar workpiece.

24. The workbench according to claim 1, further comprising:

a movable frame portion that is adapted to tilt so as to define a supporting surface for said planar workpiece that is movable to a range of angles from horizontal to vertical.

25. The workbench according to claim 1, further comprising:

a rotary foot fitted to a threaded shaft which enables raising and lowering of a foot so that said workbench can be positioned on an uneven surface.

26. The workbench according to claim 1, wherein said crosspiece comprises at least one of:

a light fitting; or a magnetic portion; and/or a residual current detector; and/or a spirit level; and/or an alarm formed therewith.

* * * * *